US008655218B2

(12) United States Patent
Hata

(10) Patent No.: US 8,655,218 B2
(45) Date of Patent: Feb. 18, 2014

(54) IMAGE FORMING APPARATUS WITH AT LEAST ONE CHANNEL FOR ENSURING AIR FLOW

(75) Inventor: Yohsuke Hata, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 140 days.

(21) Appl. No.: 13/284,436

(22) Filed: Oct. 28, 2011

(65) Prior Publication Data

US 2012/0107010 A1 May 3, 2012

(30) Foreign Application Priority Data

Oct. 29, 2010 (JP) ..... 2010-244229

(51) Int. Cl.
*G03G 21/18* (2006.01)
*G03G 21/20* (2006.01)

(52) U.S. Cl.
USPC ..... 399/92; 399/112

(58) Field of Classification Search
USPC ..... 399/92, 107, 111, 112
See application file for complete search history.

(56) References Cited

U.S. PATENT DOCUMENTS

2010/0129111 A1 5/2010 Tamura
2012/0087693 A1 * 4/2012 Yamaguchi et al. ..... 399/92

FOREIGN PATENT DOCUMENTS

JP 2007-086539 A 4/2007
JP 2010-128053 A 6/2010

OTHER PUBLICATIONS

Japan Patent Office, Notification of Reason for Refusal for Japanese Patent Application No. 2010-244229 (counterpart Japanese patent application), dispatched Jan. 22, 2013.

* cited by examiner

*Primary Examiner* — Sophia S Chen
(74) *Attorney, Agent, or Firm* — Baker Botts L.L.P.

(57) ABSTRACT

An image forming apparatus includes: a first process unit and a second process unit arranged in parallel and each having a photosensitive drum configured to form an electrostatic latent image by an exposure and a charging device configured to charge the photosensitive drum; an exposing unit disposed between the first process unit and the second process unit and configured to expose the photosensitive drum of the second process unit; a first flow channel formed between the first process unit and the exposing unit for supplying air to the charging device of the second process unit; and a second flow channel formed in the first process unit and having an outlet for supplying the air to the charging device of the second process unit.

20 Claims, 6 Drawing Sheets

IMAGE FORMING APPARATUS WITH AT LEAST ONE CHANNEL FOR ENSURING AIR FLOW

CROSS-REFERENCE TO RELATED APPLICATION

This application is based upon and claims the benefit of priority of Japanese Patent Application No. 2010-244229 filed on Oct. 29, 2010, the contents of which are incorporated herein by reference in its entirety.

BACKGROUND

The present disclosure relates to an image forming apparatus including a plurality of process units which are disposed in parallel.

There has been known a charging device, in which ions are generated by applying voltage to a wire-shaped or comb-shaped electrode and contacted on a surface of a photosensitive drum to charge the photosensitive drum.

An image forming apparatus is known, which includes a plurality of process cartridges (process units) having a photosensitive drum and a charging device and disposed in parallel and an LED unit (exposing unit) disposed between the process units, and is configured so that air having been passed between the process unit and the exposing unit flows toward the charging device and the photosensitive drum which is disposed in the front of the charging device. In the above configuration, it is possible to efficiently charge the photosensitive drum or prevent attachment of a foreign material to an electrode of the charging device.

SUMMARY

However, recently, there is a demand to make the image forming apparatus small and accordingly, and further make narrow the distance between the process unit and the exposing unit. As a result, in the configuration in which the air flows toward the charging device, since an air flow channel becomes narrow, there is problem in that the flow rate of the air flowing into the charging device may be decreased.

Therefore, the present disclosure has been made in an effort to provide an image forming apparatus capable of implementing a small-sized apparatus while ensuring the flow rate of air flowing toward a charging device.

An aspect of the present disclosure provides an image forming apparatus comprising:

a first process unit and a second process unit arranged in parallel and each having a photosensitive drum configured to form an electrostatic latent image by an exposure and a charging device configured to charge the photosensitive drum;

an exposing unit disposed between the first process unit and the second process unit and configured to expose the photosensitive drum of the second process unit;

a first flow channel formed between the first process unit and the exposing unit for supplying air to the charging device of the second process unit; and a second flow channel formed in the first process unit and having an outlet for supplying the air to the charging device of the second process unit.

DESCRIPTION OF EXEMPLARY EMBODIMENTS

Hereinafter, exemplary embodiments of the present disclosure will be described in detail with reference to accompanying drawings. First, an overall configuration of a color printer 1 as an image forming apparatus will be briefly described and then, a detailed configuration of the color printer 1 will be described.

Further, a direction used in the following description is a direction view from a user using the color printer 1. That is, in FIG. 1, the left side indicates "forward", the right side indicates "backward", the forward indicates "right", and the backward indicates "left". A longitudinal direction of FIG. 1 indicates a "top and bottom".

Overall Configuration of Color Printer

Figure 1:
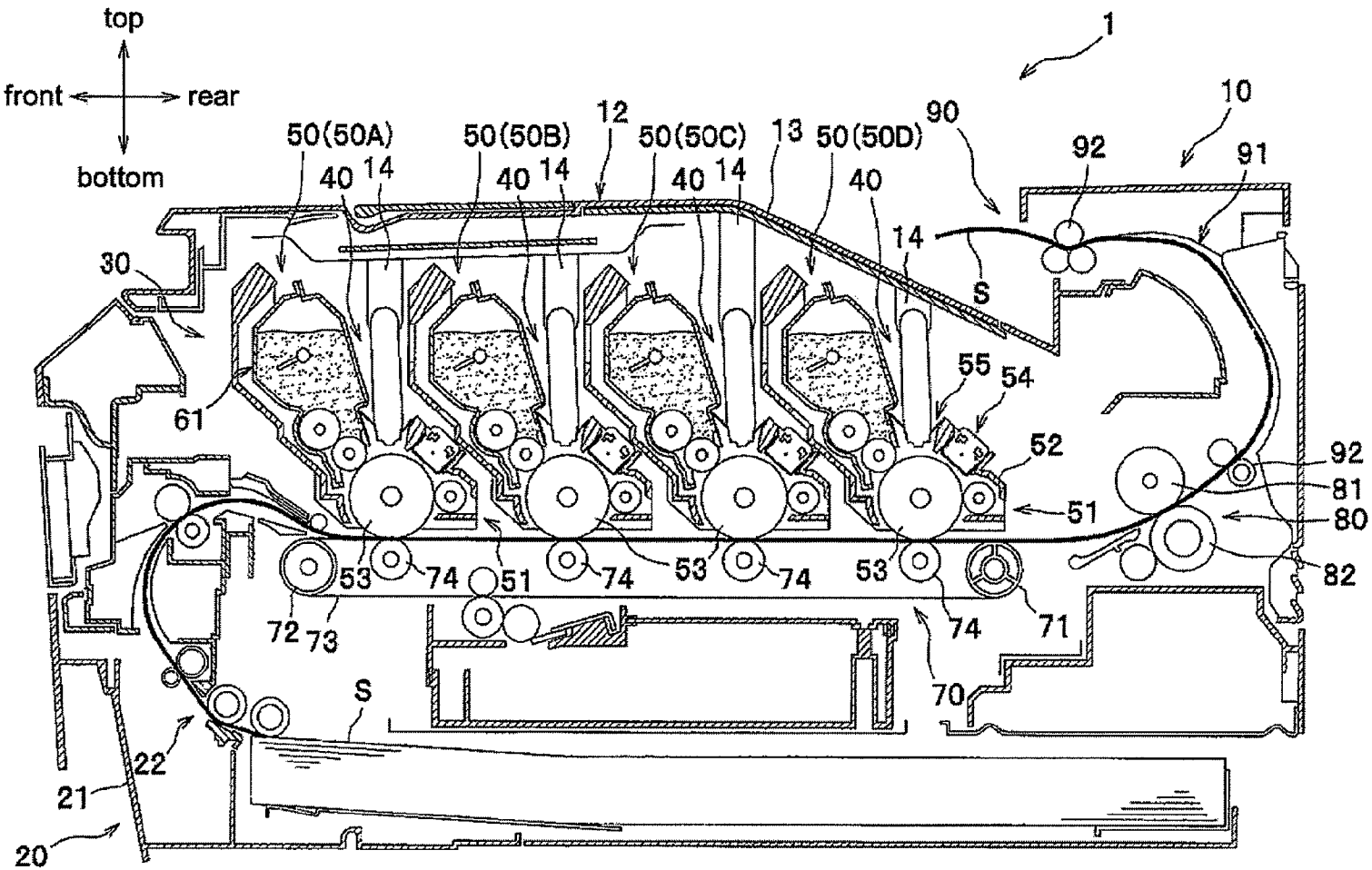
FIG. 1 is a diagram illustrating an overall configuration of a color printer as an image forming apparatus according to an exemplary embodiment.

As shown in FIG. 1, a color printer 1 includes a sheet feeding unit 20 supplying sheets S in a main body case 10, an image forming unit 30 forming an image on the supplied sheets S, and a sheet discharging device 90 discharging sheets S on which the image is formed.

An upper cover 12 which can be rotated (opened and closed) up and down based on the rear side is provided at the upper side in the main body case 10. A discharging tray 13 on which sheets S discharged from the main body case 10 are placed is provided on an upper surface of the upper cover 12 and four holding units 14 holding an LED unit 40 are provided on a lower surface thereof.

The sheet feeding unit 20 mainly includes a sheet feeding tray 21 disposed at the lower side in the main body case 10 to receive sheets S and a sheet supplying mechanism 22 supplying sheets S from the sheet feeding tray 21 to the image forming unit 30. Sheets S in the sheet feeding tray 21 are separated one by one by the sheet supplying mechanism 22 and supplied to image forming unit 30.

The image forming unit 30 includes four LED units 40, four process units 50, a transfer unit 70, and a fixing unit 80.

The LED units 40 are disposed to face each other above a photosensitive drum 53 with the upper cover 12 being closed, and include a plurality of light emitting units (LEDs) (not shown) arranged in a left-right direction at a front end (lower end) thereof. When the light emitting units flicker based on image data, the LED units 40 expose the photosensitive drum 53 after charging. Since the LED units 40 are held at the upper cover 12 through the holding unit 14, the LED units 40 are separated from photosensitive drum 53 by opening the upper cover 12.

Process units 50 are disposed in parallel between the upper cover 12 and the sheet feeding unit 20 along a forward-backward direction and are detachably mounted on the main body case 10 with the upper cover 12 open. The process units 50 include a photosensitive unit 51 and a developing unit 61 detachably mounted on photosensitive unit 51 (a photosensitive frame 52) as an example of a developing device.

The photosensitive unit 51 includes the photosensitive frame 52 as an example of a frame, the photosensitive drum 53 in which an electrostatic latent image is formed by the exposure, and a charging device 54 charging photosensitive drum 53. A developing unit 61 is mounted on the photosensitive frame 52 to form an exposure hole 55 capable of seeing photosensitive drum 53 from the outside. The LED units 40 are inserted into the exposure hole 55 so as to face an upper part of the photosensitive drum 53 by closing the upper cover 12.

Figure 2:
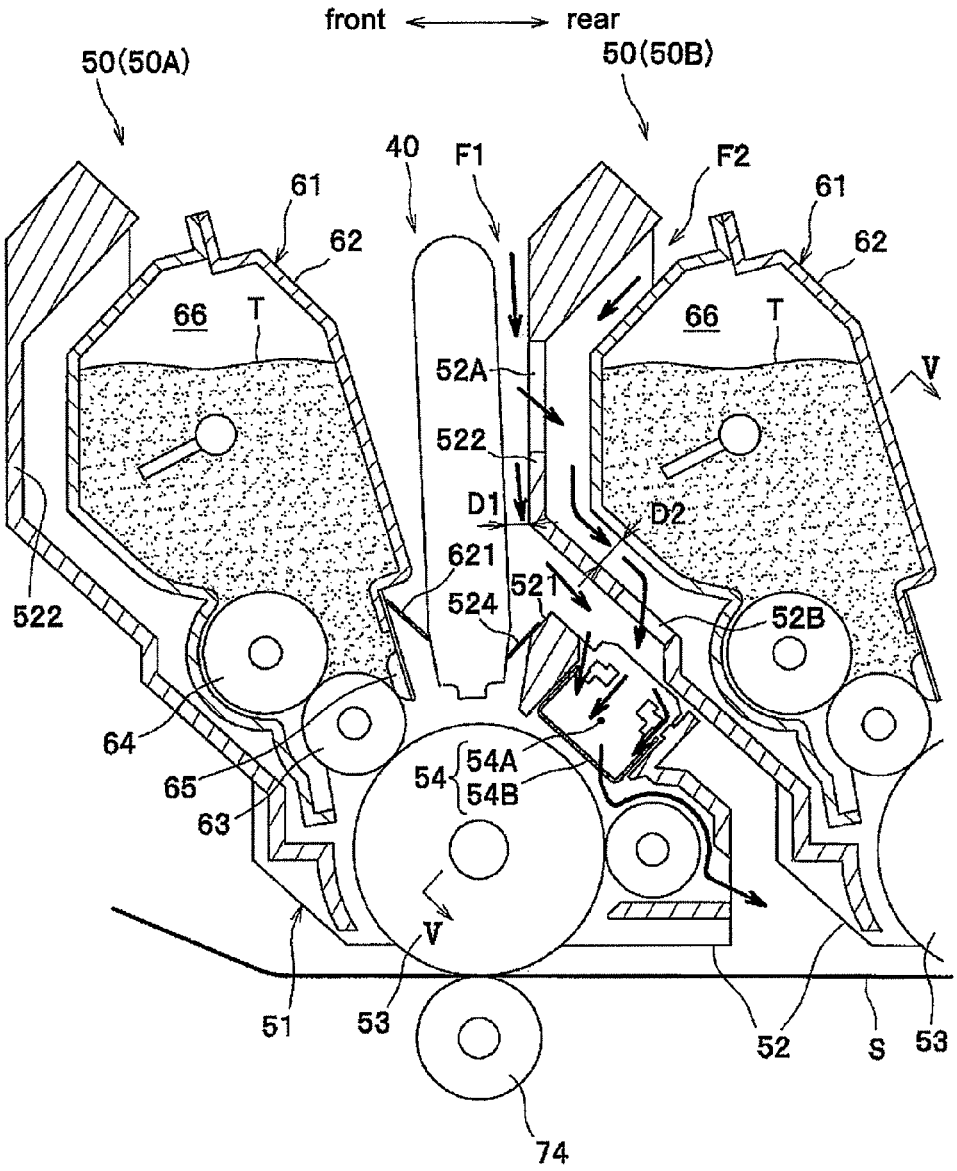
FIG. 2 is an enlarged diagram of a process unit and an LED unit.

As shown in FIG. 2, the developing unit 61 includes a developing frame 62, a developing roller 63, a supply roller 64, a layer-thickness control blade 65, and a toner containing unit 66 containing a toner T (a developer) supplied to photosensitive drum 53 as an example of a developer containing unit.

Referring back to FIG. 1, the transfer unit 70 is provided between the sheet feeding unit 20 and the process unit 50 and includes a driving roller 71, a driven roller 72, an endless conveying belt 73 spanned between the driving roller 71 and the driven roller 72, and four transfer rollers 74. An outer side of the conveying belt 73 is abutted to each photosensitive drum 53 and each transfer roller 74 is disposed at an inner side thereof so as to insert and support conveying belt 73 between each transfer roller 74 and each photosensitive drum 53.

A fixing unit 80 is provided at the rear of the process unit 50 and the transfer unit 70, and includes a heating roller 81 and a pressure roller 82 which is disposed to face the heating roller 81 to press the heating roller 81.

In the image forming unit 30, the surface of the photosensitive drum 53 is uniformly charged by the charging device 54 and then, exposed by the LED units 40, such that an electrostatic latent image is formed on the photosensitive drum 53 based on image data. Toner T in the toner containing unit 66 is supplied to developing roller 63 through the supply roller 64 and is entered between the developing roller 63 and the layer-thickness control blade 65 so as to be carried on the developing roller 63 as a thin layer having a regular thickness.

The toner T carried on the developing roller 63 is supplied to the photosensitive drum 53, such that the electrostatic latent image becomes visible image to form a toner image on the photosensitive drum 53. Thereafter, a sheet S supplied from the sheet feeding unit 20 is conveyed between the photosensitive drum 53 and the conveying belt 73 (transfer roller 74), such that the toner images formed on photosensitive drums 53 are superimposed and transferred on the sheet S in sequence. The sheet S in which the toner image is transferred is conveyed between the heating roller 81 and the pressure roller 82 and then, the toner image is heat-fixed.

The sheet discharging device 90 includes a sheet discharging path 91 for guiding sheets S drawn out from the fixing unit 80 and a plurality of conveying rollers 92 conveying sheets S. Sheets S in which the heat-fixed toner image is heat-fixed are conveyed to the sheet discharging path 91 by the conveying rollers 92 and discharged to the outside of the main body case 10 to be disposed on the sheet discharging tray 13.

Detailed Configuration of Color Printer

Next, a detailed configuration of the color printer 1 will be described. As shown in FIG. 2, the color printer 1 includes a first flow channel F1 and a second flow channel F2 to supply air to the charging device 54 of the process unit 50A (a second process unit). The color printer 1 includes a ventilating fan (not shown) and the air (see arrow) passes through first flow channel F1 and the second flow channel F2 by driving the ventilation fan so as to flow toward the charging device 54 of the process unit 50A.

In the exemplary embodiment, a rear process unit 50 corresponds to a "first process unit" and the front process unit 50 corresponds to a "second process unit", among two adjacent process units 50 in a forward-backward direction. The LED unit 40, which is disposed between adjacent the process units 50 (the first process unit and the second process unit) and exposes the photosensitive drum 53 of front process unit 50 (the second process unit), corresponds to an "exposing unit".

Specifically, as shown in FIG. 1, in a pair of a foremost process unit 50A and a second foremost process unit 50B from the front, the process unit 50A corresponds to a second process unit and the process unit 50B corresponds to a first process unit. In a pair of the second process unit 50B and a third process unit 50C from the front, the process unit 50B corresponds to the second process unit and the process unit 50C corresponds to the first process unit. In a pair of the process unit 50C and the rearmost process unit 50D, the process unit 50C corresponds to a second process unit and the process unit 50D corresponds to a first process unit.

Hereinafter, unless particularly mentioned, the expressions "process unit 50" represents common matters for four process units 50, and "process unit 50B" represents individual matter for the first process unit.

Referring back to FIG. 2, the process unit 50 includes the photosensitive frame 52, the photosensitive drum 53, the charging device 54, and the developing unit 61. The photosensitive drum 53 is a photoreceptor in which a photosensitive layer is formed on a surface (outer circumferential surface) of a cylindrical drum body having conductivity and is configured so as to be rotatably driven in a counterclockwise direction in FIG. 2.

The charging device 54 is disposed to face the surface of the photosensitive drum 53 with a predetermined distance at the rear side inclined when going upward of the photosensitive drum 53 and includes a wire electrode 54A and a grid electrode 54B. The charging device 54 of the process unit 50A (the second process unit) is disposed between the photosensitive drum 53 of the process unit 50A and process unit 50B.

The wire electrode 54A is a metallic wire generating a corona discharge caused by an applied voltage for exposing the photosensitive drum 53 and is elongated along an axial direction of the photosensitive drum 53 (left-right direction).

The grid electrode 54B is a metallic plate member controlling an amount of ions reaching the surface of the photosensitive drum 53 and includes a plurality of grid holes (a reference numeral is omitted) at a portion disposed so as to face the photosensitive drum 53 between the wire electrode 54A and the photosensitive drum 53.

In the charging device 54, the corona discharge is generated by applying voltage to the wire electrode 54A to ionize air around the wire electrode 54A. The ionized air moves toward the photosensitive drum 53 by an attraction due to a potential difference or an air flow to contact the surface of the photosensitive drum 53, such that the surface of the photosensitive drum 53 is charged.

Figure 3:
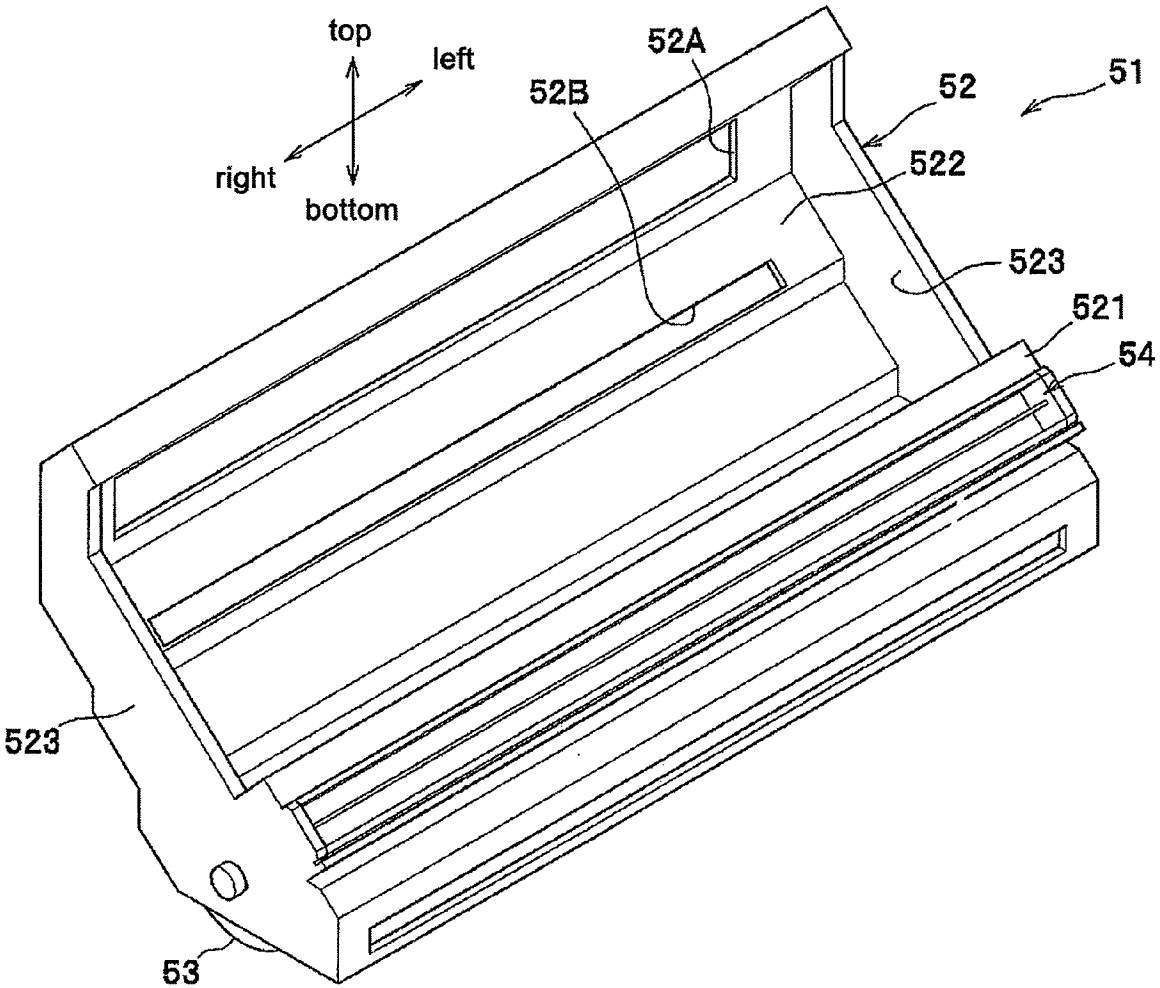
FIG. 3 is a perspective view of a photosensitive unit.

The photosensitive frame 52 is a frame constituting an outer frame of the photosensitive unit 51 and as shown in FIG. 3, includes a drum support 521, a front wall portion 522 as an example of a first wall and a second wall, and a pair of side wall portions 523 of left and right. The photosensitive frame 52 is configured so that the developing unit 61 (not shown in FIG. 3) is detachably mounted on a concave portion formed by drum support 521, front wall portion 522, and the pair of side wall portions 523.

The drum support 521 is a portion formed in a substantially box shape below the photosensitive frame 52 and rotatably supports the photosensitive drum 53, and supports the charging device 54 (the wire electrode 54A and the grid electrode 54B) at a predetermined position for the photosensitive drum 53.

As shown in FIG. 2, the drum support 521 has a film 524 preventing a gap between the LED units 40 and the drum support 521 in the state where the process unit 50 is mounted on the main body case 10 and the upper cover 12 is closed. The film 524 is elongated in a left-right direction, and one end thereof is fixed at the drum support 521 by an adhesion and the like and the other end thereof is abutted with the LED units 40. The film 524 can prevent the air from passing through the gap between the LED units 40 and the drum support 521 (the photosensitive frame 52) to flow toward the photosensitive drum 53. As a result, in the exemplary embodiment, the air passing through first flow channel F1 can be ensured to flow toward the charging device 54.

The same film member is also provided at the developing frame 62. In more detail, the developing frame 62 includes the film 621 blocking a gap between the LED units 40 and the developing frame 62. The film 621 is elongated in a left-right direction, and one end thereof is fixed at the developing frame 62 and the other end thereof is abutted with the LED units 40. Accordingly, in the exemplary embodiment, the air is also prevented from passing through the gap between the LED units 40 and the developing frame 62 to flow toward photosensitive drum 53.

The front wall portion 522 is provided to face the developing unit 61 mounted on the photosensitive frame 52 in a substantially forward-backward direction. The front wall portion 522 of the process unit 50B (the first process unit) is provided between the developing unit 61 of the process unit 50B and the charging device 54 of the process unit 50A (the second process unit) and the LED units 40 exposing the photosensitive drum 53 of the process unit 50A in the state where the process unit 50 is mounted on the main body case 10.

More specifically, in the state where the process unit 50 is mounted on the main body case 10, the front wall portion 522 of the process unit 50B extends substantially obliquely upwardly toward the front side from around the vicinity of the front of the photosensitive drum 53 of the process unit 50B toward the LED units 40 exposing the photosensitive drum 53 of the process unit 50A and then, extends substantially upward from between the LED units 40 and the process unit 50B.

The first flow channel F1 is formed between the front wall portion 522 (process unit 50B), the LED units 40 exposing the photosensitive drum 53 of the process unit 50A, and the charging device 54 of the process unit 50A.

The second flow channel F2 is formed inside of the process unit 50B, specifically, between the front wall portion 522 of the process unit 50B and the developing unit 61 mounted on the photosensitive frame 52 of the process unit 50B. The rear side wall of walls forming the second flow channel F2 is the developing frame 62 forming the toner containing unit 66. That is, in the exemplary embodiment, a part of the walls forming the second flow channel F2 is also used as a wall of the toner containing unit 66.

The temperature of toner T in the toner containing unit 66 may be increased by absorbing heat and the like generated from the fixing unit 80 when the color printer 1 operates. Accordingly, a part of the walls forming the second flow channel F2 is used as the wall of the toner containing unit 66 and therefore, when the air passes through the second flow channel F2, the passing air removes the heat. As a result, the toner T in the toner containing unit 66 can be cooled down.

In the exemplary embodiment, a minimum width D2 of the second flow channel F2 (between the front wall portion 522 and the developing unit 61) is larger than a minimum width D1 of first flow channel F1 (between the front wall portion 522 and the LED unit 40). Accordingly, the distance between front wall portion 522 (process unit 50B) and LED units 40 is decreased, such that color printer 1 can be made small and a passage of the air can be ensured by the second flow channel F2.

The front wall portion 522 of process unit 50B is provided so as to partition the first flow channel F1 and the second flow channel F2. Two through holes, in detail, an inlet 52 A for introducing the air from the first flow channel F1 to the second flow channel F2 and an outlet 52B for supplying the air passing through the second flow channel F2 to the charging device 54 of the process unit 50A (for flowing toward charging device 54), are formed in the front wall portion 522 of the process unit 50B.

The inlet 52A is formed in the upstream side (upper side) of the front wall portion 522 in an air-flow direction at the first flow channel F1 and the second flow channel F2 as compared with a portion at which the distance between the front wall portion 522 and the LED units 40 is minimized (a portion at which the first flow channel F1 has minimum width D1), in front wall portion 522. Further, the outlet 52B is formed in the downstream (lower side) of the front wall portion 522 in the air-flow direction at the first flow channel F1 and the second flow channel F2, as compared with a portion at which the first flow channel F1 has the minimum width D1, more particularly, at a portion which faces the charging device 54 of the process unit 50A (substantially a rear side inclined when going upward the charging device 54).

Since the inlet 52A is formed at the front wall portion 522 to make the air to be able to intercommunicate between the first flow channel F1 and the second flow channel F2, the air may flow to one of the first flow channel F1 and the second flow channel F2 through which the air can flow easier. As a result, the flow rate of the air flowing toward the charging device 54 of the process unit 50A can be ensured. An upper side edge portion of the second flow channel F2, that is, a gap between the photosensitive frame 52 and the developing unit 61 is communicated with an upper space of the process unit 50B and the second flow channel F2 can introduce the air even from the upper side edge portion (so-called a second inlet).

As shown in FIGS. 2 and 3, in the exemplary embodiment, an area of the outlet 52B (an area of the outlet 52B viewed in a direction perpendicular to the surface in which the outlet 52B of the front wall portion 522 is formed) is smaller than an area of the inlet 52A (an area of the inlet 52A viewed in a direction perpendicular to the surface in which the inlet 52A of the front wall portion 522 is formed).

Accordingly, the air introduced from the inlet 52A or the upper side edge portion to the second flow channel F2 finally passes through narrow the outlet 52B to flow toward the charging device 54 of the process unit 50A, such that a flow velocity of the air is increased. The air having the increased flow velocity enters into the charging device 54 and flows around the wire electrode 54A, such that it is difficult for a foreign material such as silica and the like to be attached to the wire electrode 54A. As a result, it is possible to prevent the foreign material from being attached to the wire electrode 54A.

As shown in FIG. 2, since the charging device 54 is not provided in the front of the process unit 50A, in the exemplary embodiment, the photosensitive frame 52 of the process unit 50A is configured so as not to have the through-holes (inlet and outlet) in front wall portion 522. However, in order to reduce the manufacturing cost by sharing a component of process unit 50 (the photosensitive frame 52), the photosensitive frame 52 of the process unit 50A having the inlet 52A or the outlet 52B in the front wall portion 522 may be utilized.

Therefore, the exemplary embodiment acquires operational effects as described below. Since the color printer 1 includes the second flow channel F2 formed in the process unit 50B (first process unit) in addition to the first flow channel F1 as a flow channel for supplying the air to the charging device 54 of the process unit 50A (the second process unit), color printer 1 can be made small by narrowing the distance between the process unit 50 and the LED units 40 and the flow rate of the air flowing toward the charging device 54 of the process unit 50A can be ensured.

As a result, since a lot of ions generated from the charging device 54 can flow toward the photosensitive drum 53, the photosensitive drum 53 can be efficiently charged. Since the flow rate of the air flowing around the wire electrode 54A is secured, it is possible to prevent the foreign material from being attached to the wire electrode 54A.

In the color printer 1, since a part of the walls forming the second flow channel F2 is used as the wall of the toner containing unit 66, the toner T in the toner containing unit 66 can be cooled down.

In the color printer 1, since the second flow channel F2 is formed between the front wall portion 522 of the process unit 50B and the developing unit 61 mounted on the photosensitive frame 52 of the process unit 50B, the process unit 50B having the second flow channel F2 can be easily and cheaply manufactured, as compared with the case where the second flow channel is formed in the process unit which is not detachable.

Figure 5A:
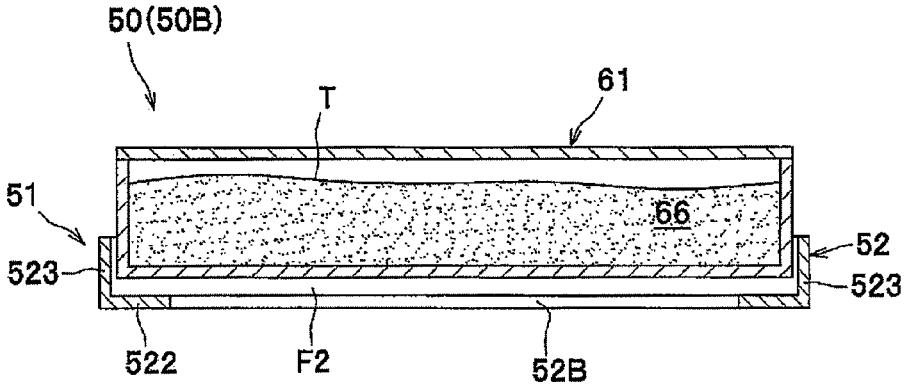
FIG. 5A is a cross-sectional view taken along the line V-V of FIG. 2, and FIGS. 5B and 5C are cross-sectional views illustrating the configuration of a first process unit according to another modified example taken along the line V-V of FIG. 2.
Figure 5B:
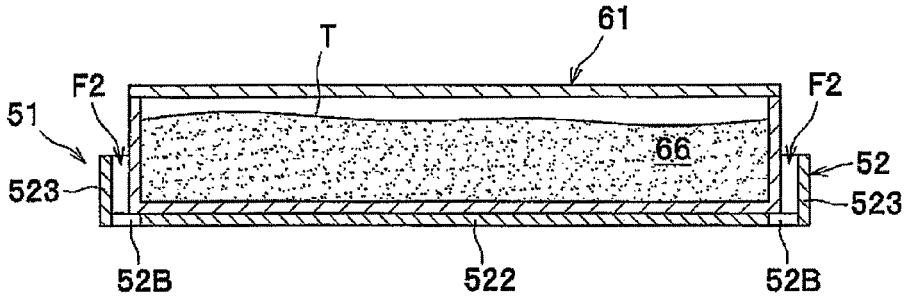
Figure 5C:
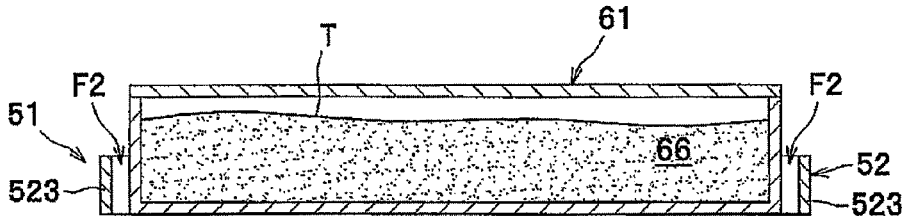

In the color printer 1, since the photosensitive frame 52 includes the front wall portion 522 (the second wall) and the outlet 52B is formed at the front wall portion 522, strength of the photosensitive frame 52 can be improved, as compared with a configuration in which the photosensitive frame 52 does not include the second wall (see FIG. 5C). In other words, according to the exemplary embodiment, the second flow channel F2 can be formed while the strength of the photosensitive frame 52 (the process unit 50) is maintained.

Since the inlet 52A is formed at the front wall portion 522, the air can intercommunicate between the first flow channel F1 and the second flow channel F2 and the air may flow to a flow channel to which the air easily flows, such that the flow rate of the air flowing toward the charging device 54 can be ensured.

In particular, in the exemplary embodiment, since the inlet 52A is formed at the upper side than a portion at which the first flow channel F1 has minimum width D1 and the outlet 52B is formed at the lower side than a portion at which the first flow channel F1 has minimum width D1, the air is not concentrated at a narrow portion of the first flow channel F1 and can flow toward the charging device 54 although the air flows via the second flow channel F2. Accordingly, the flow rate of the air flowing toward the charging device 54 can be ensured.

In the exemplary embodiment, since the outlet 52B is formed at a portion which faces the charging device 54, the air from the second flow channel F2 can directly flow toward the charging device 54.

In the color printer 1, since the area of the outlet 52B is smaller than the area of the inlet 52A, when the air passes through the outlet 52B, a flow velocity thereof is increased, such that it is possible to more prevent the foreign material from being attached to the wire electrode 54A.

In the color printer 1, since minimum width D2 of the second flow channel F2 is larger than minimum width D1 of the first flow channel F1, color printer 1 can be made small and a passage of the air can be ensured.

As described above, the exemplary embodiments are described, but the present invention is not limited to the exemplary embodiments. A detailed configuration can be properly changed within the range without deviating from the scope of the present invention.

In the exemplary embodiment, minimum width D2 of the second flow channel F2 is larger than minimum width D1 of the first flow channel F1, but the present invention is not limited thereto. For example, minimum width D2 of the second flow channel F2 may be equal to minimum width D1 of the first flow channel F1. Further, the width of each flow channel may be narrowed toward, for example, the downstream in a flow direction of the air and may also be constant.

In the exemplary embodiment, the area of the outlet 52B is smaller than that of the inlet 52A, but the present invention is not limited thereto and for example, the area of the outlet 52B may be larger than or equal to that of the inlet 52A.

Figure 4:
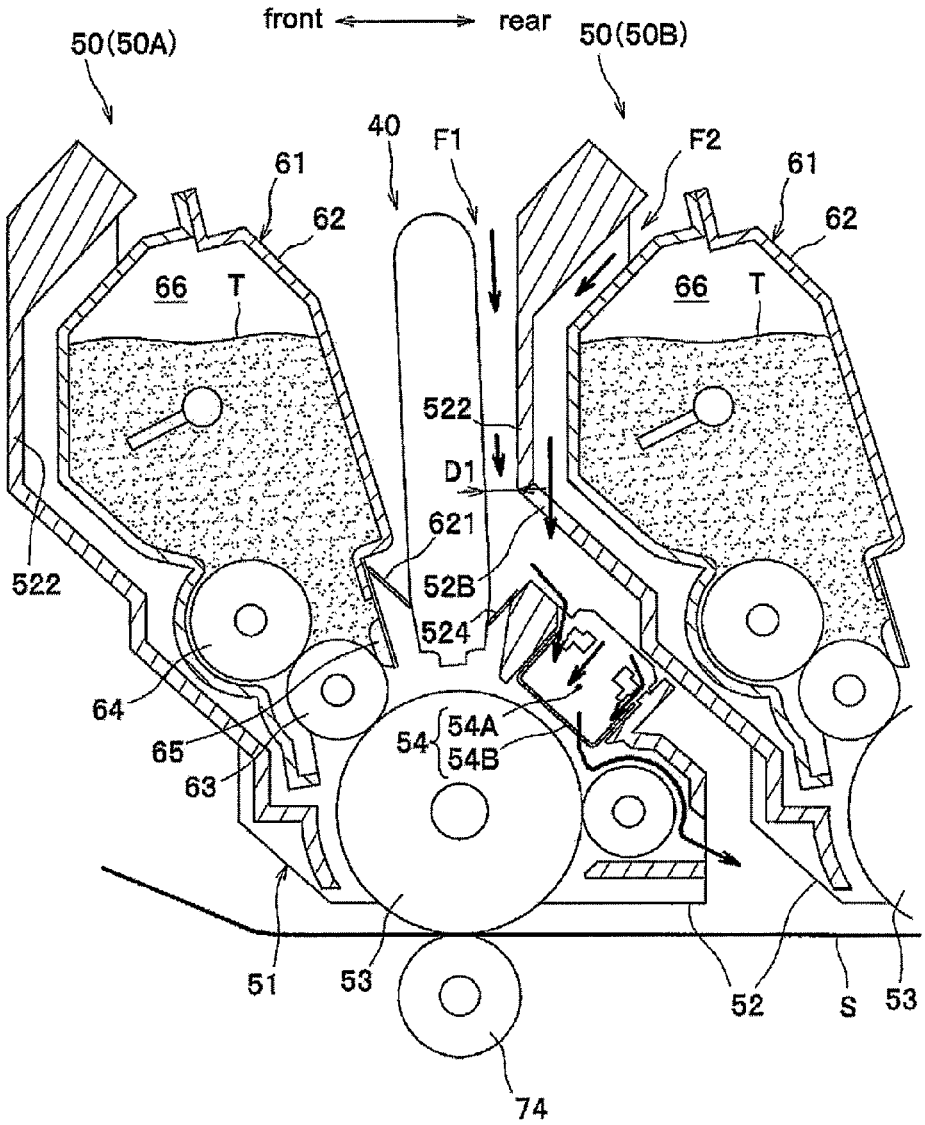
FIG. 4 is an enlarged diagram of a process unit and an LED unit according to a modified example.

In the exemplary embodiment, the outlet 52B is formed at the portion which faces the charging device 54 of the front wall portion 522, but the present invention is not limited thereto. As shown in FIG. 4, the outlet 52B may be formed, for example, at a portion which is the upper side of the charging device 54 (around a portion at which the first flow channel F1 has minimum width D1), in the front wall portion 522, as long as the air passing through the second flow channel F2 can be supplied to the charging device 54 of the process unit 50A.

According to the exemplary embodiment, as shown FIG. 3, the inlet 52A and the outlet 52B substantially form a rectangle and each of which is formed in one rectangular shape, but the present disclosure is not limited thereto. For example, the inlet 52A and the outlet 52B may have a plurality of elongated slit-shaped through-holes which are formed in parallel in a left-right direction or an up-down direction. According to the exemplary embodiment, the inlet 52A and the outlet 52B are formed across almost the full width of the front wall portion 522 in a left-right direction, but the present disclosure is not limited thereto. For example, when a ventilation fan is provided on any one side wall of left and right of color printer 1, the inlet 52A and the outlet 52B may be formed to be close to an opposite side to a side where the ventilation fan is provided. That is, in the present disclosure, a shape, the number, a formed position, a formed range, and the like of the inlet 52A or the outlet 52B are not particularly limited, as long as a configuration thereof can exhibit a function of each opening.

In the exemplary embodiment, the inlet 52A is formed at the front wall portion 522 (the second wall), but the present invention is not limited thereto. For example, as shown in FIG. 4, the inlet 52A may not be formed at the front wall portion 522. In the exemplary embodiment shown in FIG. 4, the air passing through the second flow channel F2 is introduced from the gap between the photosensitive frame 52 of the upper side edge portion of the second flow channel F2 and the developing unit 61, passes through the outlet 52B, and flows toward the charging device 54 of the process unit 50A. That is, in the exemplary embodiment shown in FIG. 4, the upper side edge portion of the second flow channel F2 is formed as an inlet (a reference numeral is omitted) for introducing the air to the second flow channel F2.

In the exemplary embodiment, as shown in FIGS. 2 and 5A, the first wall and the second wall are the same wall (the front wall portion 522), the second flow channel F2 is formed between the front wall portion 522 and the developing unit 61 and the outlet 52B (through-hole) is formed at the front wall portion 522, but the first wall and the second wall may be different from each other. For example, as shown in FIG. 5B, the first wall is utilized as the side wall portion 523 of the photosensitive frame 52 and the second is utilized as the front wall portion 522, such that the second flow channel F2 is formed between the side wall portion 523 and the developing unit 61 and the outlet 52B (through-hole) is formed at front wall portion 522. In FIG. 5, the photosensitive drum 53 and the charging device 54 of the process unit 50A are not shown.

In the exemplary embodiment, the photosensitive frame 52 includes the front wall portion 522 (the second wall) and the outlet 52B is formed at the front wall portion 522, but the present disclosure is not limited thereto. For example, as shown in FIG. 5C, the photosensitive frame 52 may not include the front wall portion 522 (the second wall) as shown in FIGS. 5A and 5B. In the configuration, for example, the second flow channel F2 may be formed between the side wall portion 523 and the developing unit 61. In the exemplary embodiment shown in FIG. 5C, the upper side edge portion of the second flow channel F2 is formed as an inlet and the lower edge of the second flow channel F2 is formed as an outlet for supplying the air to a charging device (not shown).

In the exemplary embodiment, the process unit 50 is configured to be detachable from the main body case 10, but the present invention is not limited thereto. For example, the developing unit 61 (developing device) may be configured to be detachable from the photosensitive unit 51 fixed to the main body case 10. The developing unit 61 (developing device) may be configured so that a portion including the developing roller 63 or the supplying roller 64 and a portion containing toner T (the toner containing unit 66) can be detached (divided).

Figure 6:
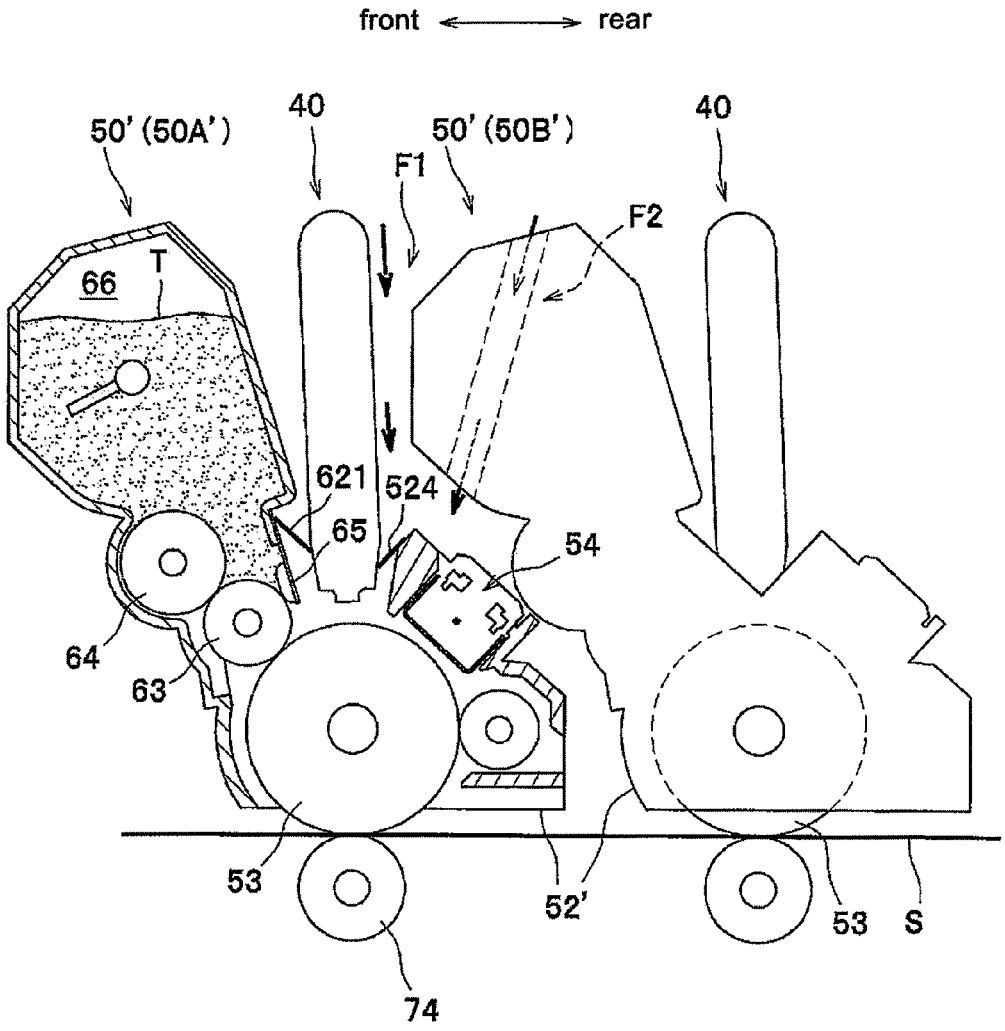
FIG. 6 is an enlarged diagram of a process unit and an LED unit according to another modified example.

In the exemplary embodiment, the process unit 50 in which the developing unit 61 (developing device) can be detachably mounted at the photosensitive unit 51 (the photosensitive frame 52) is exemplified, but the present invention is not limited thereto. For example, as shown in FIG. 6, a process unit 50' may include the photosensitive drum 53, the charging device 54, the developing roller 63, the supplying roller 64, the layer-thickness control blade 65, and the toner containing unit 66 in a frame 52' where the photosensitive unit 51 and the developing unit 61 of the exemplary embodiment are integrally formed (cannot be divided).

In the exemplary embodiment, the second flow channel F2 is formed between the front wall portion 522 (the first wall) of the process unit 50B and developing unit 61 (developing device) mounted on the photosensitive frame 52 of the process unit 50B, but the present invention is not limited thereto. For example, as shown in FIG. 6, the second flow channel F2 may be formed so as to pass though the inside (the toner containing unit 66) of a process unit 50B' (the second process unit) formed not able to be divided. A side wall of the process unit formed not able to be divided may have a double-wall structure and a gap between two sheets of walls (an outside wall and an inside wall) may serve as the second flow channel.

In the exemplary embodiment, a part of the walls forming the second flow channel F2 is used as a wall of the toner containing unit 66 (developer containing unit), but the present disclosure is not limited thereto. For example, almost all walls forming the second flow channel may be the wall of the developer containing unit, and the wall forming the second flow channel may not be a common wall with the developer containing unit.

In the exemplary embodiment, the charging device 54 including the wire electrode 54A is exemplified, but the present invention is not limited thereto. That is, the charging device may have any configuration as long as the corona discharge is generated by applying voltage. For example, a charging device (saw-toothed charging device) and the like may have needle-shaped electrodes (comb-shaped electrodes) arranged in a line.

In the exemplary embodiment, as the exposing unit disposed between the first process unit and the second process unit, the LED units 40 with LEDs being arranged are exemplified, but the present invention is not limited thereto. For example, an exposing unit may include an EL element or a fluorescent substance instead of the LED and in the exposing unit, an optical shutter of a liquid crystal element or a PLZT element may be arranged at an emitting side of a backlight of a fluorescent lamp, an LED, or the like. The exposing unit may be a laser scanner exposing the surface of the photosensitive drum after charging and the like, by scanning a laser light on the surface of the photosensitive drum at high speed.

In the exemplary embodiment, the color printer 1 (printer) is exemplified as an image forming apparatus, but the present invention is not limited. For example, the image forming apparatus may be a copier, a complex machine, or the like including a document scanning device such as a flatbed scanner and the like.

What is claimed is:

1. An image forming apparatus comprising:

a first process unit and a second process unit arranged in parallel and each having a photosensitive drum configured to form an electrostatic latent image by an exposure and a charging device configured to charge the photosensitive drum;

an exposing unit disposed between the first process unit and the second process unit and configured to expose the photosensitive drum of the second process unit;

a first flow channel formed between the first process unit and the exposing unit for supplying air to the charging device of the second process unit; and a second flow channel formed in the first process unit and having an outlet for supplying the air to the charging device of the second process unit, wherein the first process unit includes:

a developer containing unit configured to contain a developer to be supplied to the photosensitive drum of the first process unit, the developer containing unit including a wall which at least partially forms the second flow channel;

a frame supporting the photosensitive drum and the charging device of the first process unit; and a developing device including the developer containing unit, the developing device being detachably mounted on the frame, wherein the frame includes a first wall facing the mounted developing device, the second flow channel is formed between the first wall and the developing device, the frame of the first process unit is disposed between the developing device of the first process unit and the charging device of the second process unit, and between the developing device of the first processing unit and the exposing unit of the second process unit, the frame includes a second wall that partitions the first flow channel and the second flow channel, and the outlet is formed at the second wall, and wherein an inlet for introducing the air to the second flow channel is formed at the second wall.

2. The apparatus according to claim 1, wherein the inlet is formed in an upstream side in an air-flow direction than a portion where a distance between the second wall and the exposing unit is the minimum, and the outlet is formed in a downstream side in the air-flow direction than a portion where a distance between the second wall and the exposing unit is the minimum.

3. The apparatus according to claim 2, wherein the outlet is formed at a portion facing the charging device of the second process unit.

4. The apparatus according to claim 2, wherein a minimum width of the second flow channel is larger than that of the first flow channel.

5. The apparatus according to claim 1, wherein an area of the outlet is smaller than that of the inlet.

6. The apparatus according to claim 1, wherein the first flow channel communicates with the second flow channel through the inlet.

7. The apparatus according to claim 1, wherein a minimum width of the second flow channel is larger than that of the first flow channel.

8. The apparatus according to claim 1, wherein the exposing unit includes a LED.

9. An image forming apparatus comprising:

a first process unit and a second process unit arranged in parallel and each having a photosensitive drum configured to form an electrostatic latent image by an exposure and a charging device configured to charge the photosensitive drum;

an exposing unit disposed between the first process unit and the second process unit and configured to expose the photosensitive drum of the second process unit;

a first flow channel formed between the first process unit and the exposing unit for supplying air to the charging device of the second process unit; and a second flow channel formed in the first process unit and having an outlet for supplying the air to the charging device of the second process unit; and wherein the first process unit includes a frame supporting the photosensitive drum, the frame including:

a wall that partitions the first flow channel and the second flow channel, and an inlet for introducing air to the second flow channel that is formed at the wall.

10. An image forming apparatus comprising:

a first process unit and a second process unit arranged in parallel and each having a photosensitive drum configured to form an electrostatic latent image by an exposure and a charging device configured to charge the photosensitive drum;

an exposing unit disposed between the first process unit and the second process unit and configured to expose the photosensitive drum of the second process unit;

a first flow channel formed between the first process unit and the exposing unit for supplying air to the charging device of the second process unit; and a second flow channel formed in the first process unit and having an outlet for supplying the air to the charging device of the second process unit; and a film provided at the charging device of the second process unit, the film being configured to contact the exposing unit of the second process unit to prevent the air from passing through a gap between the charging device of the second process unit and the exposing unit of the second process unit.

11. The apparatus according to claim 10, wherein the first process unit includes a developer containing unit configured to contain a developer to be supplied to the photosensitive drum of the first process unit, and the developer containing unit includes a wall which at least partially forms the second flow channel.

12. The apparatus according to claim 11, wherein the first process unit includes: a frame supporting the photosensitive drum and the charging device of the first process unit; and a developing device including the developer containing unit, the developing device being detachably mounted on the frame, the frame includes a first wall facing the mounted developing device, and the second flow channel is formed between the first wall and the developing device.

13. The apparatus according to claim 12, wherein the frame of the first process unit is disposed between the developing device of the first process unit and the charging device of the second process unit, and between the developing device of the first process unit and the exposing unit of the second process unit, the frame includes a second wall that partitions the first flow channel and the second flow channel, and the outlet is formed at the second wall.

14. The apparatus according to claim 13, wherein an inlet for introducing the air to the second flow channel is formed at the second wall.

15. The apparatus according to claim 14, wherein the inlet is formed in an upstream side in an air-flow direction than a portion where a distance between the second wall and the exposing unit is the minimum, and the outlet is formed in a downstream side in the air-flow direction than a portion where a distance between the second wall and the exposing unit is the minimum.

16. The apparatus according to claim 15, wherein the outlet is formed at a portion facing the charging device of the second process unit.

17. The apparatus according to claim 14, wherein an area of the outlet is smaller than that of the inlet.

18. The apparatus according to claim 14, wherein the first flow channel communicates with the second flow channel through the inlet.

19. The apparatus according to claim 10, wherein a minimum width of the second flow channel is larger than that of the first flow channel.

20. The apparatus according to claim 10, wherein the exposing unit includes a LED.

* * * * *